US005397129A

United States Patent [19]

Kato et al.

[11] Patent Number: 5,397,129

[45] Date of Patent: Mar. 14, 1995

[54] THREAD WOUND GOLF BALL

[75] Inventors: Akira Kato, Kobe; Keiji Moriyama, Akashi, both of Japan

[73] Assignee: Sumitomo Rubber Industries, Ltd., Hyogo, Japan

[21] Appl. No.: 71,984

[22] Filed: Jun. 7, 1993

[30] Foreign Application Priority Data

Jun. 9, 1992 [JP] Japan ..... 4-149302
Feb. 10, 1993 [JP] Japan ..... 5-022464

[51] Int. Cl.[6] ..... A63B 37/06
[52] U.S. Cl. ..... 273/227; 273/230
[58] Field of Search ..... 273/230, 222, 223, 225, 273/226, 227, 228, 229, 231, 214, 216

[56] References Cited

U.S. PATENT DOCUMENTS 2,609,201 9/1952 Martin ..... 273/230
4,076,255 2/1978 Moore et al. ..... 273/226
4,696,475 9/1987 Tomita ..... 273/230 X
4,781,383 11/1988 Kamada et al. ..... 273/230 X
4,858,924 8/1989 Saito ..... 273/235 R
4,919,434 4/1990 Saito ..... 273/218
4,955,966 9/1990 Yuki et al. ..... 273/230 X
5,072,944 12/1991 Nakahara et al. ..... 273/230 X
5,141,233 8/1992 Yuki et al. ..... 273/235 R X
5,150,905 9/1992 Yuki et al. ..... 273/218

FOREIGN PATENT DOCUMENTS 2296439 12/1975 France .
2134798 8/1984 United Kingdom .

*Primary Examiner*—George J. Marlo
*Attorney, Agent, or Firm*—Birch Stewart Kolasch & Birch

[57] ABSTRACT

The present invention provides a thread wound golf ball having excellent hit feeling, which is obtained by winding a thread rubber around a solid rubber center to form a thread rubber layer and covering the thread rubber layer with a cover layer. A surface hardness (JIS-A) of the rubber center is not more than 60 and a deformation on 500 g loading of the rubber center is not less than 0.5 mm.

11 Claims, 1 Drawing Sheet

THREAD WOUND GOLF BALL

BACKGROUND OF THE INVENTION

1. Field of the Invention

The present invention relates to a thread wound golf ball.

2. Description of the Related Art

A thread wound golf ball is obtained by winding a thread rubber around a solid or liquid rubber center to form a thread rubber layer and covering the thread rubber layer with a cover material (e.g. ionomer, balata. etc.). As the solid center, a vulcanized rubber of butadiene is conventionally used, which has high hardness and low compression deformation. In a golf ball using such a conventional center, the formation of spin is large and launch angle is small and, therefore, the golf ball is disadvantageous in view of flying distance. Further, the curving of the flight of the golf ball is too large and it is sometimes hard to control.

On the other hand, a liquid center has high compression deformation. In a golf ball using the liquid center, the formation of spin is small and launch angle is large and, therefore, the golf ball is advantageous in view of flying distance in comparison with a conventional solid center. In golf balls having liquid center, however, the production process is complicated. Also, there is a problem of safety, for example, when a ball is cut by a knife or a cutter, a liquid is sprayed out, which may result in loss of eyesight.

SUMMARY OF THE INVENTION

In order to solve the above problem, the present inventors have intensively studied. As a result, it has been found that, by using a flexible vulcanized rubber as a solid center of a thread wound golf ball, the formation of spin is suppressed and launch angle is increased, whereby, exceptionally long flying distance can be obtained, and the present invention has been completed.

The main object of the present invention is to provide a thread wound golf ball which is superior in flying distance and hit feeling.

This object as well as other objects and advantages of the present invention will become apparent to those skilled in the art from the following description.

According to the present invention, there is provided a thread wound golf ball obtained by winding a thread rubber around a solid rubber center to form a thread rubber layer and covering the thread rubber layer with a cover layer, wherein the solid rubber center has a surface hardness (JIS-A) of not more than 60 and a deformation on 500 g loading of not less than 0.5 mm.

DETAILED DESCRIPTION OF THE INVENTION

Figure 1:
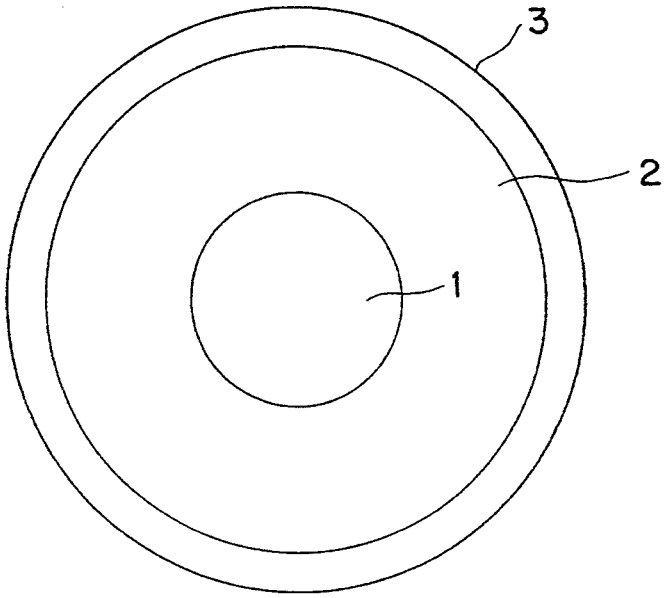
FIG. 1 is a cross-sectional view of a golf ball having a cover layer, a thread-wound layer, and a center.

FIG. 1 shows the cross-sectional structure of a thread wound golf ball, according to the present invention. The rubber center 1 has a surface hardness (JIS-A) of not more than 60, and a deformation on 500 g loading of not less than 0.5 mm, as discussed below. Thread rubber layer 2 comprises a thread rubber wound around the solid rubber center. Cover layer 3 covers the thread rubber layer.

The rubber center used in the present invention has a surface hardness (JIS-A) of not more than 60, preferably 10 to 45, and a deformation (500 g loading) of not less than 0.5 mm. When the surface hardness (JIS-A) of the rubber center is larger than upper limit of the above range, the formation of spin on hitting becomes large and impact strength is large, which results in inferior hit feeling. Further, when the deformation (500 g loading) is smaller than the lower limit of the above range, the formation of spin also becomes large and hit feeling becomes inferior.

The outer diameter of the rubber center is preferably 23 to 34 mm, more preferably 26 to 32 mm. When the outer diameter is smaller than 23 mm, the formation of spin becomes large and launch angle becomes small. On the other hand, when the outer diameter is larger than 34 mm, the thread rubber layer becomes thin and a golf ball having a predetermined hardness can not be obtained.

When the rubber center does not have a suitable impact resilience, the initial velocity on hitting becomes small, which results in bad influence ion the rubber center. The impact resilience is represented by the rebound height of the rubber center which is measured by dropping it on a rigid surface such as concrete block from a height of 254 cm (100 inches) at 23° C. The impact resilience is preferably 90 cm or more. When it is smaller than 90 cm, the initial velocity of the golf ball becomes too small and the effect of the center is hardly obtained.

The rubber for the rubber center is not specifically limited, and examples thereof include butadiene rubber (BR), natural rubber (NR), ethylene-propylene-diene copolymer (EPDM), polynorbornene rubber, silicone rubber and the like. Polynorbornene rubber and silicone rubber are particularly preferred. Polynorbornene rubber can contain a large amount of oil and easily obtain flexibility. The polynorbornene rubber can also be controlled in a suitable impact resilience by selecting the oil.

In order to prevent deformation of the center during winding the thread rubber around the center, it is necessary to freeze the center in advance of winding. It is therefore preferred that the rubber will be solidified at a low temperature. (e.g. −30° to −50° C.). Polynorbornene rubber will solidify at the above range even if it contains a large amount of oil.

In order To reduce hardness and to obtain a suitable impact resilience, oil is added. Non-limited examples thereof include alkylbenzene oil, naphthenic oil, paraffinic oil, aromatic oil, ester plasticizer (e.g. Dioctyl adipate (DOA), Dioctyl phthalate (DOP), etc.) and the like. Among them, naphthenic oil or alkyl benzene oil, which hardly cause blooming even if a large amount of it is added and provide high impact resilience, are particularly preferred.

The rubber center is normally obtained by kneading 100 parts by weight of the rubber, 100 to 500 parts by weight of oil, 0.5 to 5 parts by weight of sulfur, 3 to 10 parts by weight of a vulcanization auxiliary, 1 to 5 parts by weight of a vulcanization accelerator and an optional amount of a modifier by a Banbury mixer or a roll and vulcanizing a mixture at 150° to 170° C. for 10 to 20 minutes.

As the silicone rubber, for example, there are heating vulcanization type and room temperature vulcanization type silicone rubbers. In general, heating vulcanization type silicone rubber obtained by copolymerizing dimethylsiloxane as a main component with a small amount of methyl vinyl siloxane is preferred because of its good impact resilience.

As the vulcanization method of the silicone rubber, for example, there are vulcanization methods using an organic peroxide, an aliphatic azo compound, radiation, and the like.

In general, an organic peroxide is used. 0.5 to 5 Parts by weight of vulcanizing agent and an optional amount of weight modifier (based on 100 parts by weight of silicone rubber) are kneaded by a Banbury mixer or a roll and the resulting mixture is vulcanized at 150° to 170° C. for 10 to 20 minutes to obtain a vulcanized silicone rubber.

By using a flexible vulcanized silicone rubber as a solid ball center for a thread wound core, the formation of spin is suppressed and launch angle is increased. Further, exceptionally long flying distance can be obtained due to the high impact resilience of silicon.

The above vulcanization auxiliary, vulcanization accelerator and weight modifier may be any which are normally used. As the weight modifier, those having large specific gravity are preferred in order to obtain low hardness by increasing a rubber fraction of the rubber center. Examples thereof include barium sulfate, calcium carbonate, clay filler, silica filler, and the like.

A thread rubber is then wound around the rubber center while applying a stretching force to the thread rubber. The thread rubber may be any which is normally used as a thread rubber for a golf ball.

The method for covering the rubber center with a cover (ionomer or balata) is not specifically limited. Normally, the rubber center is covered with two pieces of hemispherical shape covers which have been molded in advance, followed by compression molding. Further, the rubber center may be covered by subjecting a cover composition to injection molding.

As described above, according to the present invention, there is provided a thread wound golf ball superior in flying distance and hit feeling, which has no safety problems. Further, the production process for making this golf ball is simplified.

EXAMPLES

The following Examples further illustrate the present invention in detail but are not to be construed as limiting the scope thereof.

Examples 1 to 7 and Comparative Examples 1 to 3

The formulations shown in Table 1 were mixed and then vulcanized at 155° C. for 20 minutes to make rubber centers having a diameter of 30 mm. A thread rubber which was stretched about 10 times was wound around each rubber center. Then, the thread-wound rubber centers were covered with an ionomer resin by injection molding to make thread-wound golf balls with ionomer covers. The flight performances of the resulting golf balls were evaluated by a conventional method. The results are shown in Table 2.

TABLE 1

| Component | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 |
|---|---|---|---|---|---|---|---|---|---|---|
| Norsolex NA15 *1 | 250 | 250 | 250 | — | — | 250 | 250 | — | — | — |
| BR11 | — | — | — | 100 | 70 | — | — | 100 | 100 | — |
| NR | — | — | — | — | 30 | — | — | — | — | — |
| NS116 *8 | — | — | — | — | — | — | — | — | — | 100 |
| Sunthene 255ZJ *2 | — | 50 | 150 | 50 | 50 | 50 | 150 | — | — | — |
| Sulfur | 2 | 2 | 2 | 2 | 2 | 2 | 2 | 10 | 10 | 2 |
| Zinc oxide | 5 | 5 | 5 | 5 | 5 | 5 | 5 | 5 | 5 | 5 |
| Stearic acid | 2 | 2 | 2 | 2 | 2 | 2 | 2 | 2 | 2 | 2 |
| Barium sulfate | 190 | 240 | 320 | 150 | 150 | 300 | 400 | 75 | 95 | 75 |
| Noxelar CZ *3 | — | — | — | 1.5 | 1.5 | — | — | 1.5 | 1.5 | 1.5 |
| Noxelar TT *4 | 0.8 | 0.8 | 0.8 | 0.2 | 0.2 | 0.8 | 0.8 | 0. 2 | 0.2 | 0.2 |
| Noxelar M *5 | 0.8 | 0.8 | 0.8 | — | — | 0.8 | 0.8 | — | — | — |
| Noxelar TBT-N *6 | 1.2 | 1.2 | 1.2 | — | — | 1.2 | 1.2 | — | — | — |
| Sunselar TE-G *7 | 0.4 | 0.4 | 0.4 | — | — | 0.4 | 0.4 | — | — | — |

*1: Trade name, polynorbornene rubber manufactured by Nippon Zeon Co. (150 Parts by weight of Sansen 255ZJ is added as oil)
*2: Trade name, naphthenic oil manufactured by Nippon Sun Sekiyu CO.
*3: Trade name, manufactured by Ohuchi Shinko Kagaku Kogyo Co.
*4: Trade name, manufactured by Ohuchi Shinko Kagaku Kogyo Co.
*5: Trade name, manufactured by Ohuchi Shinko Kagaku Kogyo Co.
*6: Trade name, manufactured by Ohuchi Shinko Kagaku Kogyo Co.
*7: Trade name, manufactured by Sanshin Kagaku Co.
*8: Trade name, high vinyl group-containing SBR manufactured by Nippon Zeon Co. (styrene: 20%, vinyl content in butadiene portion: 60%)

TABLE 2

| | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 |
|---|---|---|---|---|---|---|---|---|---|---|
| Ball rubber center | | | | | | | | | | |
| Outer diameter (mm) | 30.3 | 30.3 | 30.3 | 30.3 | 30.3 | 28.4 | 28.4 | 30.3 | 28.4 | 30.3 |
| Weight (g) | 20.4 | 20.5 | 20.4 | 20.4 | 20.5 | 18.2 | 18.3 | 20.5 | 18.3 | 20.5 |
| Compression deformation (mm) (1) | 1.1 | 1.5 | 2.7 | 0.7 | 0.8 | 1.3 | 2.5 | 0.4 | 0.3 | 0.5 |
| JIS-A hardness | 38 | 28 | 15 | 51 | 48 | 30 | 15 | 75 | 76 | 60 |
| Impact resilience (cm) (5) | 122 | 125 | 120 | 185 | 180 | 120 | 110 | 215 | 217 | 30 |
| Ball | | | | | | | | | | |
| Weight (g) | 45.5 | 45.3 | 45.2 | 45.5 | 45.5 | 45.3 | 45.3 | 45.3 | 45.4 | 45.5 |
| Compression (2) | 78 | 78 | 77 | 78 | 78 | 79 | 78 | 78 | 79 | 78 |
| Flight performances 1 | | | | | | | | | | |
| Launch angle (°) (3) | 11.2 | 11.4 | 11.6 | 11.0 | 11.0 | 11.3 | 11.5 | 10.8 | 10.7 | 11.0 |

TABLE 2-continued

| | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 |
|---|---|---|---|---|---|---|---|---|---|---|
| Spi Carry (yard) (3) | 225.5 | 223.5 | 223.0 | 223.0 | 223.0 | 223.0 | 224.0 | 219.0 | 217.0 | 195 |
| Total (yard) (3) | 231.5 | 229.5 | 230.0 | 229.0 | 230.0 | 229.0 | 231.0 | 225.0 | 223.0 | 210 |
| Flight performances 2 | | | | | | | | | | |
| Launch angle (°) (4) | 14.0 | 15.0 | 15.1 | 14.6 | 14.5 | 14.6 | 14.8 | 14.2 | 13.9 | 14.6 |
| Spin (rpm) (4) | 4050 | 3900 | 3850 | 4200 | 4150 | 4010 | 3980 | 4400 | 4480 | 4100 |
| Carry (yard) (4) | 178.0 | 176.5 | 176.0 | 176.0 | 176.5 | 177.0 | 176.0 | 172.0 | 171.0 | 155.0 |
| Total (yard) (4) | 181.0 | 179.0 | 178.0 | 178.0 | 178.0 | 179.0 | 179.0 | 175.0 | 175.0 | 159.0 |

(1) Deformation of a center on 500 g loading is measured by Handy compression tester manufactured by Katotec Co. (Compression rate: 0.2 mm/second)
(2) Deformation of a ball (initial load to final load) is measured by PGA system, when an initial load (10 kg) is applied to the ball and then load is gradually increased to a final load (130 kg).
(3) By using a swing-robot manufactured by Through Temper Co., a golf ball is hit at a head-club speed of about 45 m/second with a No. 1 wood golf club to measure each value.
(4) By using a swing-robot manufactured by Through Temper Co., a golf ball is hit at a head-club speed of about 38 m/second with a. No. 5 iron folf club to measure each value.
(5) A center is gravity-dropped on a concrete block of about 6 cm in thickness from a height of 254 cm (100 inches) to measure the rebound height (23° C.).

As is apparent from Table 2, regarding the golf balls of Examples 1 to 7, the flying distance was 4 to 6 yards longer than that of Comparative Examples 1 and 2. Further, as the hardness of the rubber center becomes small and the outer diameter of the rubber center becomes larger, spin was reduced and launch angle was enhanced. Regarding Comparative Example 3, the hardness of the center is small but the elasticity is extremely low and, therefore, long flying distance can not be obtained.

Professional golfers were asked to hit the golf balls and provide their evaluations. As a result, the golf balls of Examples 1 to 7 using a flexible rubber as the center had excellent hit feeling in comparison with Comparative Examples 1 to 3. The flying distance of the golf balls of Examples 1 to 7 was almost the same as that of a two piece golf ball.

Examples 8 to 10 and Comparative Example 4

According to the same manner as that described in Examples 1 to 7, a thread wound golf ball with a balata cover was made, respectively, using the formulations shown in Table 3. The flight performances of the resulting golf balls were evaluated by a conventional method. The results are shown in Table 4.

TABLE 3

| Component | Ex. 8 | Ex. 9 | Ex. 10 | Comp. Ex. 4 |
|---|---|---|---|---|
| Norsolex NA15 | 250 | 250 | 250 | — |
| Sunthene 255ZJ | 50 | 100 | 150 | — |
| BR11 | — | — | — | 100 |
| Sulfur | 2 | 2 | 2 | 10 |
| Zinc oxide | 5 | 5 | 5 | 5 |
| Stearic acid | 2 | 2 | 2 | 2 |
| Barium sulfate | 230 | 272 | 313 | 75 |
| Noxelar CZ | — | — | — | 1.5 |
| Noxelar TT | 0.8 | 0.8 | 0.8 | 0.2 |
| Noxelar M | 0.8 | 0.8 | 0.8 | — |
| Noxelar TBT-N | 1.2 | 1.2 | 1.2 | — |
| Sunselar TE-G | 0.4 | 0.4 | 0.4 | — |

TABLE 4

| | Ex. 8 | Ex. 9 | Ex. 10 | Comp. Ex. 4 |
|---|---|---|---|---|
| Ball center | | | | |
| Outer diameter (mm) | 28.4 | 28.4 | 28.4 | 28.4 |
| Weight (g) | 17.0 | 17.0 | 17.0 | 17.0 |
| Compression deformation (mm) | 1.2 | 1.9 | 2.4 | 0.3 |
| JIS-A hardness | 30 | 24 | 15 | 76 |
| Impact resilience (cm) | 125 | 123 | 120 | 220 |

TABLE 4-continued

| | Ex. 8 | Ex. 9 | Ex. 10 | Comp. Ex. 4 |
|---|---|---|---|---|
| Ball | | | | |
| Weight (g) | 45.4 | 45.3 | 45.3 | 45.3 |
| Compression | 90 | 90 | 91 | 90 |
| Flight performances 1 | | | | |
| Launch angle (°) | 10.8 | 11.0 | 11.2 | 10.0 |
| Spin (rpm) | 3200 | 3100 | 3050 | 3900 |
| Carry (yard) | 218 | 218 | 217 | 213 |
| Total (yard) | 224 | 225 | 224 | 219 |
| Flight performances 2 | | | | |
| Launch angle (°) | 14.3 | 14.5 | 14.6 | 13.0 |
| Spin (rpm) | 4400 | 4300 | 4250 | 6000 |
| Carry (yard) | 171 | 172 | 172 | 166 |
| Total (yard) | 174 | 174 | 175 | 168 |

Examples 11 to 14 and Comparative Examples 5 and 6

According to the same manner as that described in Examples 1 to 7, thread-wound golf balls with an ionomer cover were made, respectively, using the formulations shown in Table 5. The flight performances of the resulting golf balls were evaluated by a conventional method. The results are shown in Table 6.

TABLE 5

| Component | Ex. 11 | Ex. 12 | Ex. 13 | Ex. 14 | Comp. Ex. 5 | Comp. Ex. 6 |
|---|---|---|---|---|---|---|
| KE520-U *1 | 100 | — | — | 100 | — | — |
| KE530-U *2 | — | 100 | — | — | — | — |
| KE540-U *3 | — | — | 100 | — | — | — |
| BR11 | — | — | — | — | 100 | 100 |
| Barium sulfate | 52 | 50 | 43 | 70 | 75 | 95 |
| Zinc oxide | — | — | — | — | 5 | 5 |
| Stearic acid | — | — | — | — | 2 | 2 |
| C-8 *4 | 2 | — | — | 2 | — | — |
| C-4 *5 | — | 4 | 4 | — | — | — |
| Sulfur | — | — | — | — | 10 | 10 |
| Noxelar CZ *6 | — | — | — | — | 1.5 | 1.5 |
| Noxelar TT *7 | — | — | — | — | 0.2 | 0.2 |

*1: Trade name, silicone rubber compound manufactured by Shinetsu Kagaku Co.
*2: Trade name, silicone rubber compound manufactured by Shinetsu Kagaku Co.
*3: Trade name, silicone rubber compound manufactured by Shinetsu Kagaku Co.
*4: Trade name, manufactured by Shinetsu Kagaku Co.
*5: Trade name, manufactured by Shinetsu Kaguku Co.
*6: Trade name, manufactured by Ohuchi Shinko Kagaku Kogyo Co.
*7: Trade name, manufactured by Ohuchi Shinko Kagaku Kogyo Co.

TABLE 6

| | Ex. 11 | Ex. 12 | Ex. 13 | Ex. 14 | Comp. Ex. 5 | Comp. Ex. 6 |
|---|---|---|---|---|---|---|
| Ball center | | | | | | |
| Outer diameter (mm) | 30.3 | 30.3 | 30.3 | 28.4 | 30.3 | 28.4 |
| Weight (g) | 20.9 | 20.5 | 20.3 | 18.5 | 20.5 | 20.5 |
| Compression deformation (mm) (1) | 2.6 | 1.5 | 1.1 | 2.4 | 0.4 | 0.3 |
| JIS-A hardness | 25 | 36 | 43 | 17 | 75 | 75 |
| Ball | | | | | | |
| Weight (g) | 45.5 | 45.3 | 45.2 | 45.3 | 45.3 | 45.3 |
| Compression (2) | 78 | 78 | 77 | 79 | 78 | 79 |
| Flight performances 1 | | | | | | |
| Launch angle (°) (3) | 11.8 | 11.7 | 11.4 | 11.6 | 10.7 | 10.5 |
| Spin (rpm) (3) | 2850 | 2940 | 3100 | 2900 | 3300 | 3350 |
| Carry (yard) (3) | 224.5 | 223.5 | 223.0 | 223.0 | 219.5 | 219.0 |
| Total (yard) (3) | 228.0 | 225.5 | 226.0 | 225.5 | 222.0 | 221.5 |
| Flight performances 2 | | | | | | |
| Launch angle (°) (4) | 15.3 | 15.1 | 14.8 | 15.1 | 14.0 | 13.9 |
| Spin (rpm) (4) | 3650 | 3720 | 3850 | 3750 | 4010 | 4400 |
| Carry (yard) (4) | 177.0 | 176.5 | 178.0 | 177.0 | 172.5 | 172.0 |
| Total (yard) (4) | 183.5 | 184.0 | 184.0 | 183.0 | 180.0 | 179.0 |

(1) Deformation of a center on 500 g loading is measured by Handy compression tester manufactured by Katotec Co. Compression rate: 0.2 mm/second (2) Deformation of a ball (initial load to final load) is measured by PGA system, when an initial load (10 kg) is applied to the ball and then load is gradually increased to a final load (130 kg).

(3) By using a swing-robot manufactured by True Temper Co., a golf ball is hit at a head-club speed of about 45 m/second with a No. 1 wood golf club to measure each value.

(4) By using a swing-robot manufactured by True Temper Co., a golf ball is hit at a head-club speed of about 38 m/second with a No. 5 iron golf club to measure each value.

Examples 15 to 17 and Comparative Examples 7

According to the same manner as that described in Examples 8 to 10, thread-wound golf balls with a balata cover were made, respectively, using the formulations shown in Table 7. The flight performances of the resulting golf balls were evaluated by a conventional method. The results are shown in Table 8.

TABLE 7

| Component | Ex. 15 | Ex. 16 | Ex. 17 | Comp. Ex. 7 |
|---|---|---|---|---|
| KE520-U | 100 | — | — | — |
| KE530-U | — | 100 | — | — |
| KE540-U | — | — | 100 | — |
| BR11 | — | — | — | 100 |
| Barium sulfate | 45 | 37 | 32 | 70 |
| Zinc oxide | — | — | — | 5 |
| Stearic acid | — | — | — | 2 |
| C-8 | 2 | — | — | — |
| C-4 | — | 4 | 4 | — |
| Sulfur | — | — | — | 10 |
| Noxelar CZ | — | — | — | 1.5 |
| Noxelar TT | — | — | — | 0.2 |

TABLE 8

| | Ex. 15 | Ex. 16 | Ex. 17 | Comp. Ex. 7 |
|---|---|---|---|---|
| Ball center | | | | |
| Outer diameter (mm) | 28.4 | 28.4 | 28.4 | 28.4 |
| Weight (g) | 17.0 | 17.0 | 17.0 | 17.0 |
| Compression deformation (mm) | 2.5 | 1.4 | 1.0 | 0.3 |
| JIS-A hardness | 24 | 35 | 43 | 75 |
| Ball | | | | |
| Weight (g) | 45.4 | 45.3 | 45.3 | 45.4 |
| Compression | 90 | 91 | 90 | 90 |
| Flight performances 1 | | | | |
| Launch angle (°) | 11.3 | 10.9 | 10.3 | 9.5 |
| Spin (rpm) | 3100 | 3250 | 3380 | 3950 |
| Carry (yard) | 219 | 219 | 218 | 214 |
| Total (yard) | 223 | 222 | 221 | 217 |
| Flight performances 2 | | | | |
| Launch angle (°) | 15.1 | 15.0 | 14.8 | 13.5 |
| Spin (rpm) | 4150 | 4200 | 4300 | 5900 |
| Carry (yard) | 172 | 173 | 172 | 167 |
| Total (yard) | 174 | 175 | 175 | 168 |

As is apparent from Table 6, regarding the golf balls of Examples 11 to 14, the flying distance was 3 to 5 yards longer than that of Comparative Examples 5 and 6. Further, as the hardness of the rubber center becomes smaller than that of Examples 11 to 13 and Comparative Example 5 and the outer diameter of the rubber center becomes larger than that of Examples 11 and 14 and Comparative Examples 5 and 6, spin was reduced and launch angle was enhanced. In a golf ball with a balata cover as shown in Table 8, regarding the balls of Examples 15 to 17, the flying distance was 4 to 6 yards longer than that of Comparative Example 7.

Professional golfers were asked to hit the golf balls and provide their evaluations. As a result, the golf balls of Examples 11 to 14 using a vulcanized silicone rubber as the center had excellent hit feeling in comparison with Comparative Examples 5 to 7. The flying distance of the golf balls of Examples 11 to 14 was almost the same as that of a two piece golf ball.

What is claimed is:

1. A thread wound golf ball comprising:

(A) a solid rubber center comprising a vulcanized rubber having a surface hardness/JIS-A) of not more than 60 and a deformation on 500 g loading of not less than 0.5 mm;

(B) a thread rubber layer comprising a thread rubber wound around said solid rubber center; and (C) a cover layer covering the thread rubber layer.

2. The thread wound golf ball according to claim 1, wherein said solid rubber center is made of a silicone rubber.

3. The thread wound golf ball according to claim 2, wherein said silicone rubber is heating-type vulcanization silicone rubber obtained by copolymerizing dimethylsiloxane with methyl vinyl siloxane.

4. The thread wound golf ball according to claim 1, wherein said solid rubber center has an impact resilience, represented by the rebound height of the rubber center after dropping it on a rigid surface from a height of 254 cm at 23° C., of not less than 90 cm.

5. The thread wound golf ball according to claim 1, wherein said solid rubber center has an outer diameter of 23 to 34 mm.

6. The thread wound golf ball according to claim 1, wherein said solid rubber center contains a rubber selected from the group consisting of butadiene rubber, natural rubber, ethylene-propylene-diene rubber copolymer, polynorbornene rubber, silicone rubber, and mixtures thereof.

7. The thread wound golf ball according to claim 6, wherein said solid rubber center contains a rubber selected from the group consisting of polynorbornene rubber and silicone rubber.

8. The thread wound golf ball according to claim 1, wherein said solid rubber center comprises a rubber and an oil selected from the group consisting of alkylbenzene oil, naphthenic oil, paraffinic oil, aromatic oil, and ester plasticizer.

9. The thread wound golf ball according to claim 1, wherein said cover layer comprises a material selected from the group consisting of ionomer resin or balata.

10. The thread wound golf ball according to claim 1, wherein said solid rubber center has a surface hardness (JIS-A) of 10–45.

11. The thread wound golf ball according to claim 1, wherein said solid rubber center is made of polynorbornene rubber.

* * * * *